US005487643A

United States Patent [19]

Pearson

[11] Patent Number: 5,487,643

[45] Date of Patent: Jan. 30, 1996

[54] PARTIAL ADMISSION AXIAL IMPULSE TURBINE INCLUDING COVER FOR TURBINE WHEEL ROTATING ASSEMBLY

[75] Inventor: Lowell W. Pearson, Hermosa Beach, Calif.

[73] Assignee: AlliedSignal Inc., Morristown, N.J.

[21] Appl. No.: 181,326

[22] Filed: Jan. 18, 1994

[51] Int. Cl.[6] ..... F01D 9/00

[52] U.S. Cl. ..... 415/211.2; 415/208.1

[58] Field of Search ..... 415/182.1, 205, 415/208.1, 211.2

[56] References Cited

U.S. PATENT DOCUMENTS

| | | | |
|---|---|---|---|
| 2,981,516 | 4/1961 | Egli | 415/205 |
| 5,340,276 | 8/1994 | Norris et al. | 415/208.1 |

FOREIGN PATENT DOCUMENTS

| | | | |
|---|---|---|---|
| 6083503 | 7/1981 | Japan | 415/211.2 |
| 0188098 | 10/1984 | Japan | 415/208.1 |
| 0705150 | 12/1979 | U.S.S.R. | 415/182.1 |
| 0711717 | 7/1954 | United Kingdom | 415/182.1 |

*Primary Examiner*—Edward K. Look
*Assistant Examiner*—Mark Sgantzos
*Attorney, Agent, or Firm*—John R. Rafter

[57] ABSTRACT

A cover is affixed to a turbine housing on the downstream side of a turbine wheel rotating assembly to reduce a pumping loss inherently caused by a pressure gradient created by the turbine wheel blades when the turbine wheel rotates. A portion of an annular area on the exit face of the turbine wheel is left open for gas flow out of the blades being fed by the turbine nozzle or nozzles, with the remaining annular portion being covered with a close axial clearance with the turbine wheel rotating assembly to reduce the pumping loss.

14 Claims, 6 Drawing Sheets

PARTIAL ADMISSION AXIAL IMPULSE TURBINE INCLUDING COVER FOR TURBINE WHEEL ROTATING ASSEMBLY

BACKGROUND OF THE INVENTION

The blades of a rotating axial impulse turbine wheel create a pressure gradient causing what is effectively a pumping loss. This results in a loss in power and, hence, a decrease in the efficiency of the turbine.

The magnitude of the pumping loss depends at least in part on the axial clearance between the rotating turbine blades and the stationary turbine wheel housing. To this extent, the smaller the clearance, the smaller the pumping loss. Turbine design practice commonly provides for close axial clearance between the blades and the housing on the inlet side of the turbine wheel, with the outlet side usually left open to an exhaust port or duct.

Some turbines do not have nozzles covering an entire three hundred and sixty degree annular area available at the turbine blade inlet face and are commonly known as "partial admission" turbines. Since only the part of the blades passing the nozzles are filled with "driving" gas, the remaining or "unadmitted" part of the blades consume power via the aforementioned pumping loss.

The object of the present invention is to dispose a cover on the downstream side of the turbine wheel rotating assembly to reduce this pumping loss.

The present inventor is aware of the following prior art relating generally to turbines: U.S. Pat. No. 3,139,264 for a Canted Vortex Venturi which issued to Quennville, et al on Jun. 30, 1964 (U.S. Class 253-65); U.S. Pat. No. 2,608,807 for a Precision Hole Grinder which issued to Nilsen, et al on Sep. 2, 1952 (U.S. Class 51-245); and U.S. Pat. No. 4,684, 321 for a Heat Recovery System Including A Dual Pressure Turbine which issued to Barrett, et al on Aug. 4, 1987 (U.S. Class 415-202).

The '264 patent teaches a casing which appears to cover the rear face of a turbine. The function of the casing is to insure that all of the turbine wheel exhaust flow is forced to exit through a canted vortex venturi and to maintain the back pressure created by the canted vortex venturi. The present invention, on the other hand, increases turbine efficiency by minimizing the pumping loss of the blades outside of the nozzle periphery and thus relates to a different structural arrangement.

The '807 patent teaches a casing downstream of a turbine wheel and which casing does not extend far enough radially to cover the turbine blades. This is contrary to the present invention which covers the downstream side of the turbine blades to minimize pumping loss.

The '321 patent teaches a casing downstream of a first stage wheel for providing an inlet passage for a secondary flow entering the nozzles of a second stage. The structural arrangement of the '321 patent does not relate to reducing pumping loss with a downstream turbine blade cover as does the arrangement of the present invention.

SUMMARY OF THE INVENTION

This invention contemplates a partial admission axial impulse turbine including a cover for the turbine wheel rotating assembly which is affixed to the turbine housing on the downstream side of the rotating assembly to reduce a pumping loss inherently caused by a pressure gradient created by the blades when the turbine wheel rotates. The arrangement leaves a portion of the turbine wheel's annular area open for gas flow out of the blades being fed by the turbine nozzles, with the remaining annular area being covered. The cover has a close axial clearance with rotating assembly, blades, whereby the pumping loss is minimized.

More particularly, this invention contemplates a turbine of the type described including at least one nozzle for guiding the flow of gas from a turbine torus to an inlet face of a turbine wheel. The nozzle or nozzles have particular configurations at the inlet face, and which configurations define inner and outer diameters of a circumferentially extending annular area. The nozzle or nozzles fill only a portion of the annular area, with the gas flowing only through said portion. The remaining portion of the annular area is free of nozzles. A cover is affixed to a turbine wheel housing on the downstream side of the turbine wheel rotating assembly and covers the remaining portion of the annular area, whereby a pressure gradient created by the blades of the rotating turbine wheel which results in a loss in turbine power and efficiency is reduced.

DETAILED DESCRIPTION OF THE INVENTION

Figure 1:
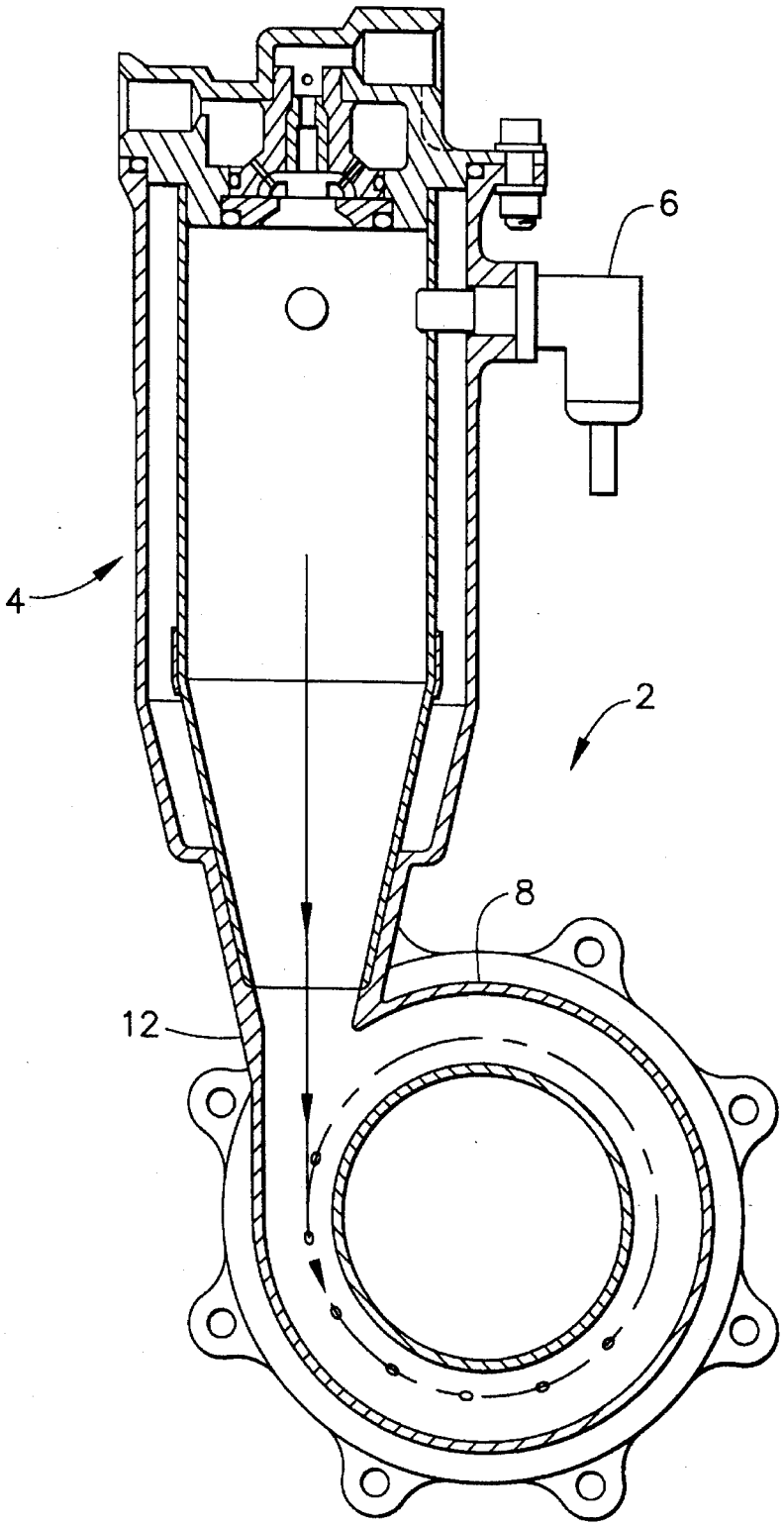
FIG. 1 (PRIOR ART)
FIG. 1 is a diagrammatic representation showing one view of a typical prior art partial admission axial impulse turbine, wherein the flow of gas from the turbine combuster into the turbine torus through a single tangential duct is illustrated.

With reference to the several Figures in the drawing wherein corresponding elements carry corresponding numerical designations, and with particular reference first to FIG. 1, a typical prior art axial impulse turbine is designated by the numeral 2. Turbine 2 includes a combuster 4, an ignitor 6 and a torus 8. Only as much of turbine 2 as is necessary to illustrate the features thereof for purposes of understanding the invention will be illustrated and described with reference to FIG. 1 and the other figures in the drawing.

Gas flows from combuster 4 and enters torus 8 through a single tangential duct 12 as illustrated by the arrows in the Figure.

Figure 2:
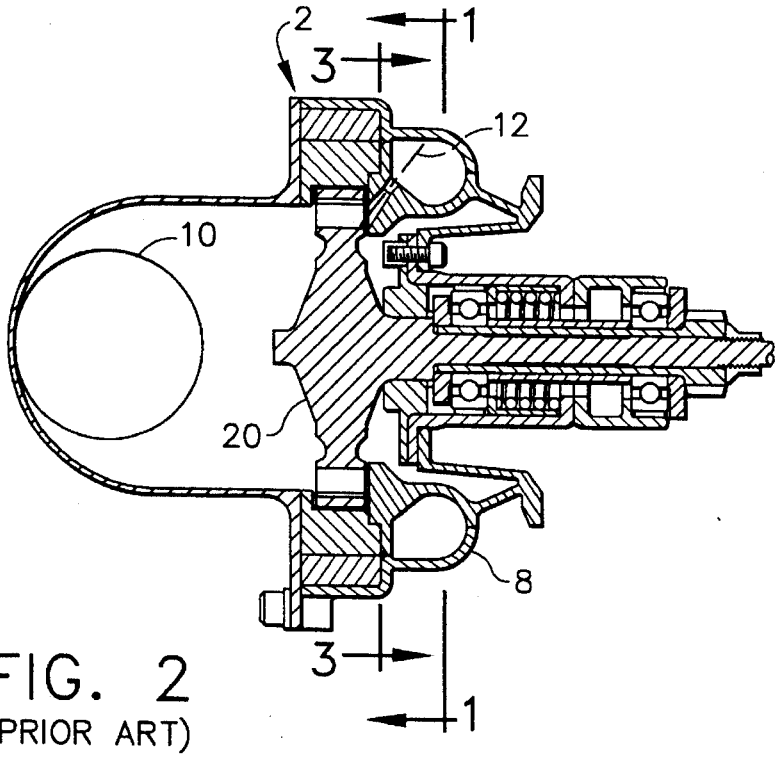
FIG. 2 (PRIOR ART)
FIG. 2 is a diagrammatic representation showing another view of the prior art turbine of FIG. 1.

Gas flowing through torus 8 leaves the torus through one or more nozzles that guide the flow of the gas to its entry at the inlet face of the turbine wheel and, in this regard, reference is made to FIG. 2, wherein exhaust duct 10 and torus 8 are further illustrated. FIG. 2 also illustrates a nozzle center line designated by the numeral 12 and a turbine wheel rotating assembly designated by the numeral 20. A typical turbine configuration features axisymmetric, usually convergent-divergent nozzles, or axial vane nozzles, as will be recognized by those skilled in the art.

Figure 3:
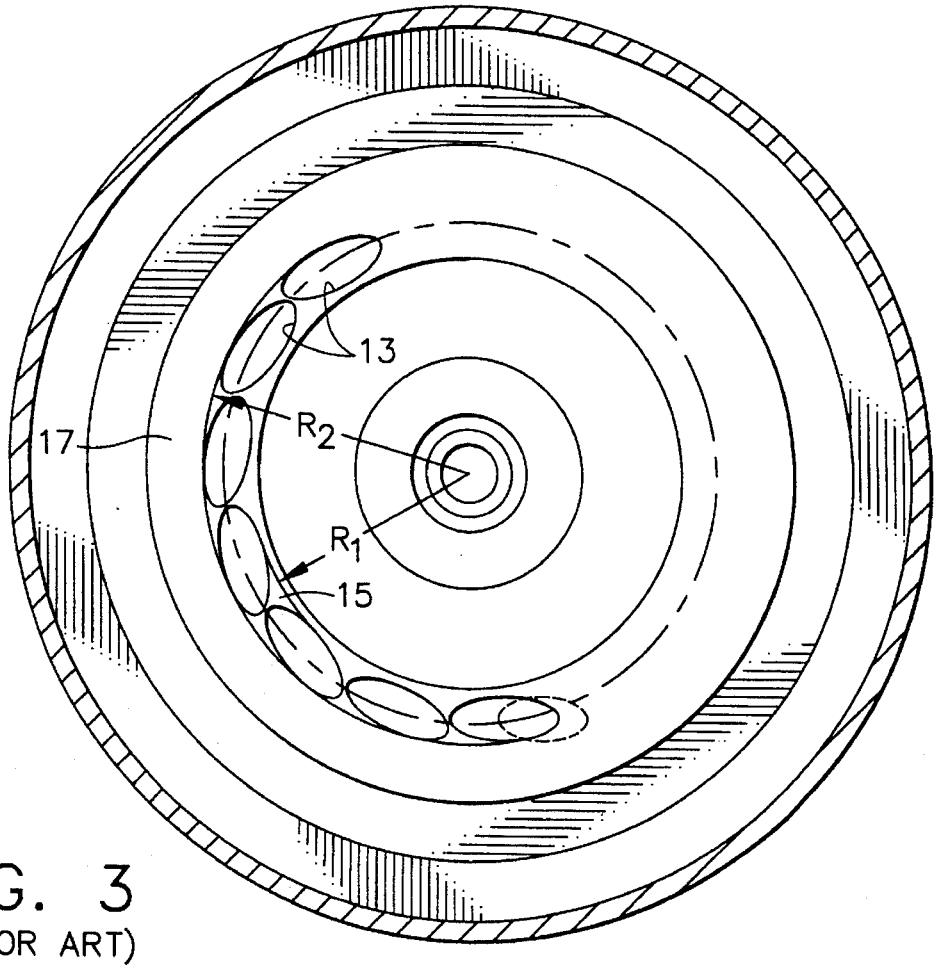
FIG. 3 (PRIOR ART)
FIG. 3 is a partial diagrammatic representation illustrating the nozzle geometry of the prior art turbine shown in FIGS. 1 and 2.

The particular geometry of nozzles 13 having a center line such as 12 is illustrated in FIG. 3. Nozzles 13 are, for example, essentially tapered holes drilled at an angle through the nozzle box to provide a circular opening. This circular opening appears as an ellipse at an inlet face 17 of a turbine wheel 20 (shown in FIG. 2). The resulting elliptical nozzle contour is shown in FIG. 3, wherein $R_1$ and $R_2$ define a circumferentially extending annular area 15.

Although the nozzle contour has been illustrated and described as being elliptical, it will be appreciated that any other nozzle configuration, i.e. rectangular, may be used with the invention as well.

Figure 4:
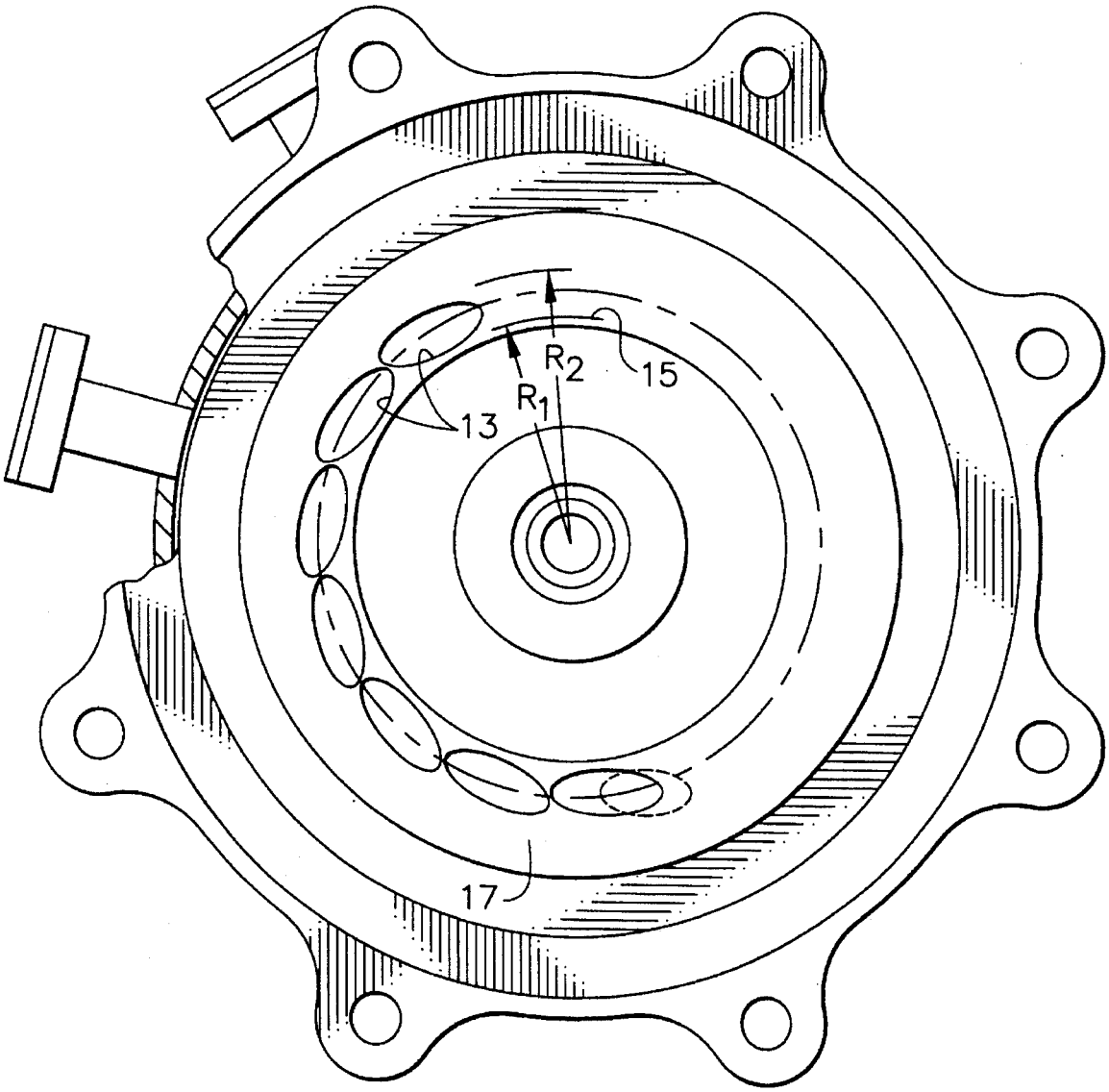
FIG. 4 (PRIOR ART)
FIG. 4 is a diagrammatic representation illustrating an approximately "fifty percent" prior art partial admission axial impulse turbine.

In some implementations, annular area 15 is larger in circumference than required for a desired nozzle flow. In these cases, the required number of nozzles 13 only partially fill annular area 15. This arrangement is designated as a "partial admission" turbine as best illustrated in FIG. 4. The remainder of the annular area is solid, i.e. without nozzles, as will be discerned with reference to FIG. 4.

It will be appreciated that the arrangement illustrated in FIG. 4 has about fifty percent of annular area 15 open for gas flow. This is called a "fifty percent admission" turbine. Since the remaining portion of annular area 15 has no gas flowing through it, it can be covered without restricting gas flow. The present invention is directed to a cover implementation for the purposes described as aforenoted.

Figure 5:
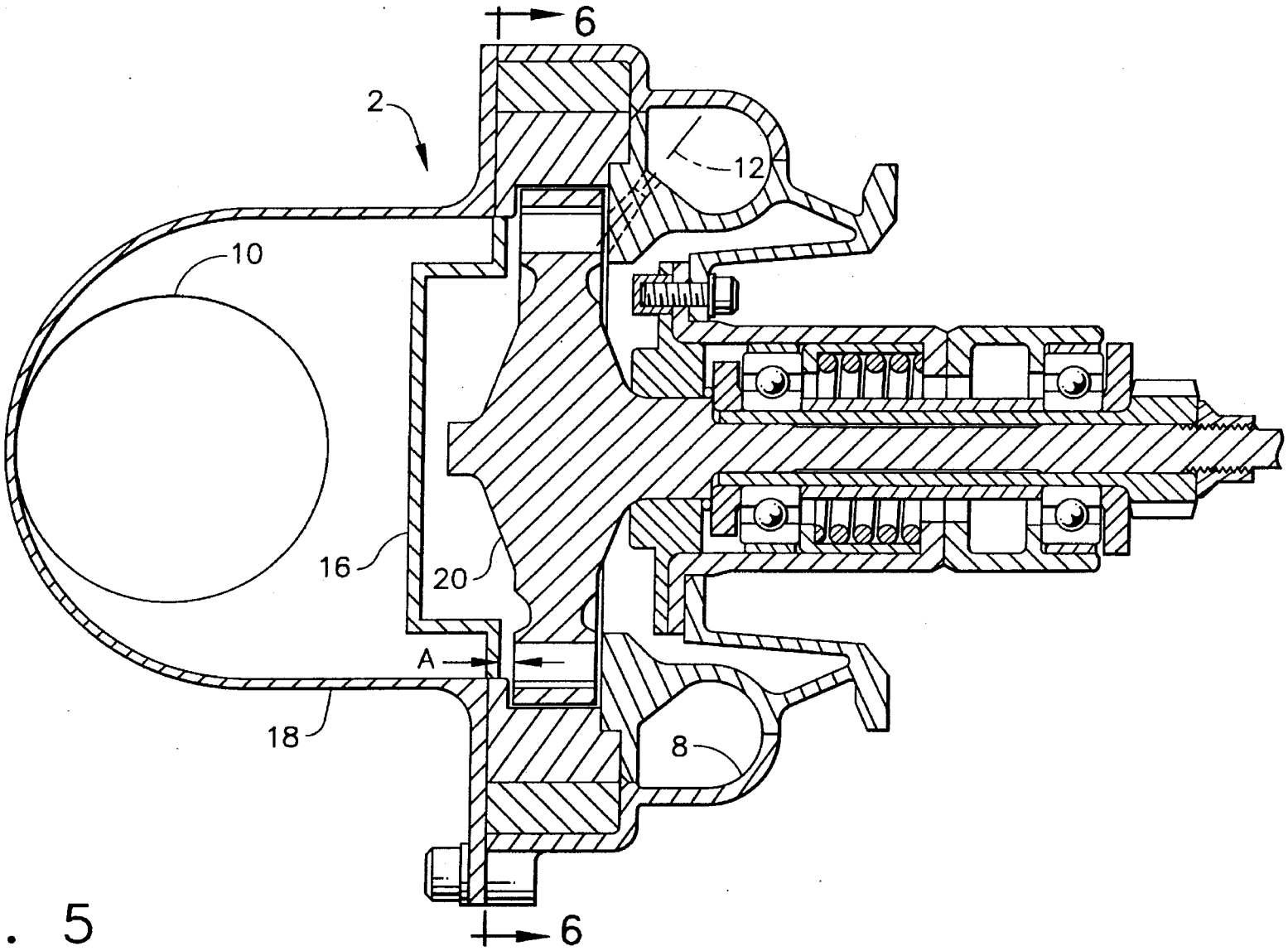
FIG. 5 is a diagrammatic representation particularly showing one view of a partial admission axial impulse turbine including a cover for the turbine wheel rotating assembly in accordance with the invention.

With particular reference to the representation of FIG. 5, which is similar to the representation of FIG. 2, except for a wheel cover in accordance with the invention which is designated by the numeral 16, cover 16 is affixed to a turbine wheel housing 18 by suitable and conventional mechanical means (not otherwise shown) and has an axial clearance with turbine wheel rotating assembly 20. This axial clearance is designated as A in the Figure. It will be appreciated that axial clearance A is minimized for optimum performance.

Figure 6:
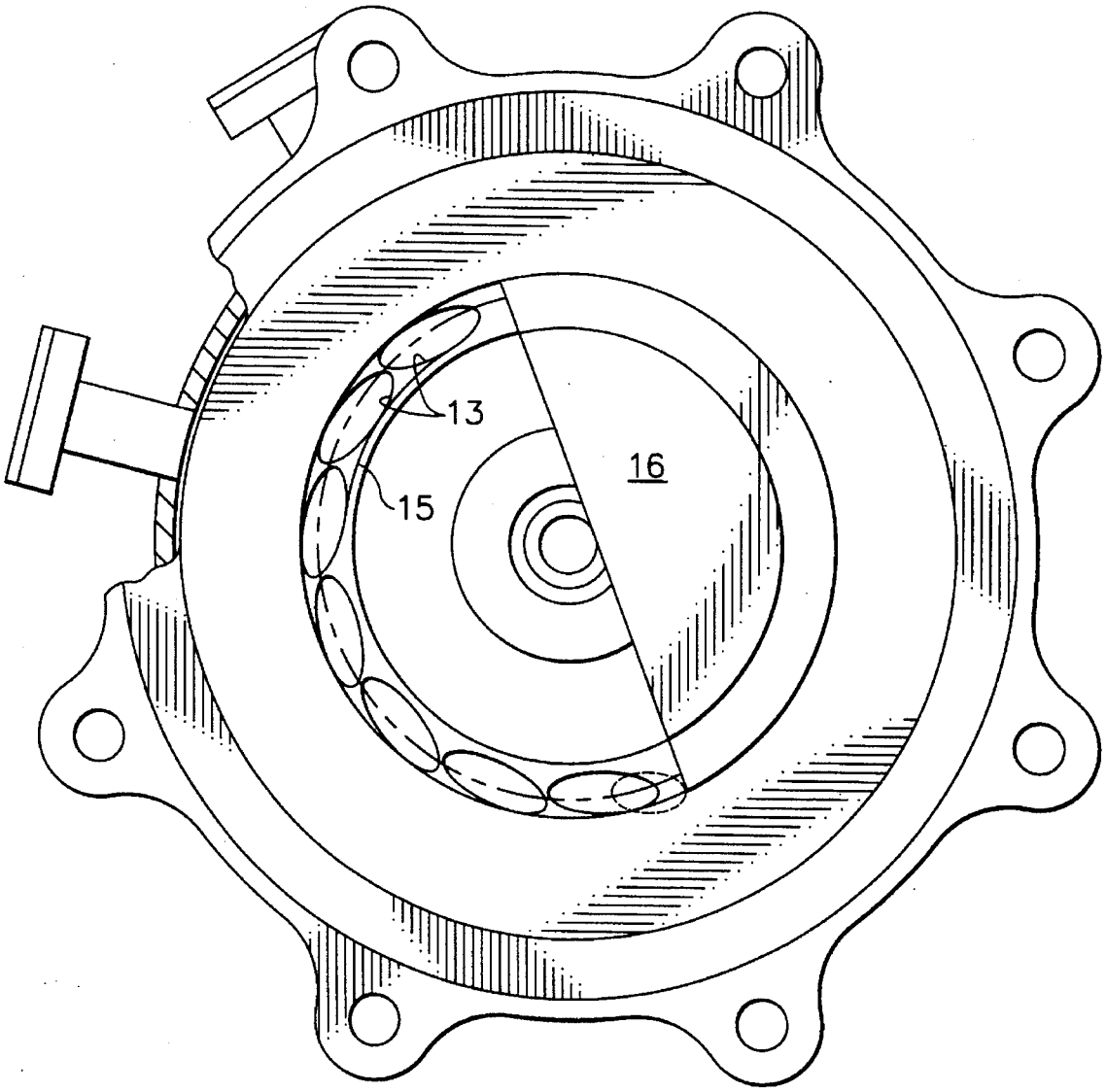
FIG. 6 is a diagrammatic representation particularly showing another view of the turbine wheel rotating assembly cover shown in FIG. 5.

With particular reference to the representation of FIG. 6 which is similar to the representation of FIG. 4, except for cover 16 which covers the unadmitted portion of the turbine wheel rotating assembly, i.e. the portion of the wheel without nozzles 13, as particularly illustrated in the FIG., cover 16 is affixed to housing 18 on the downstream side of turbine wheel rotating assembly 20.

Figure 7:
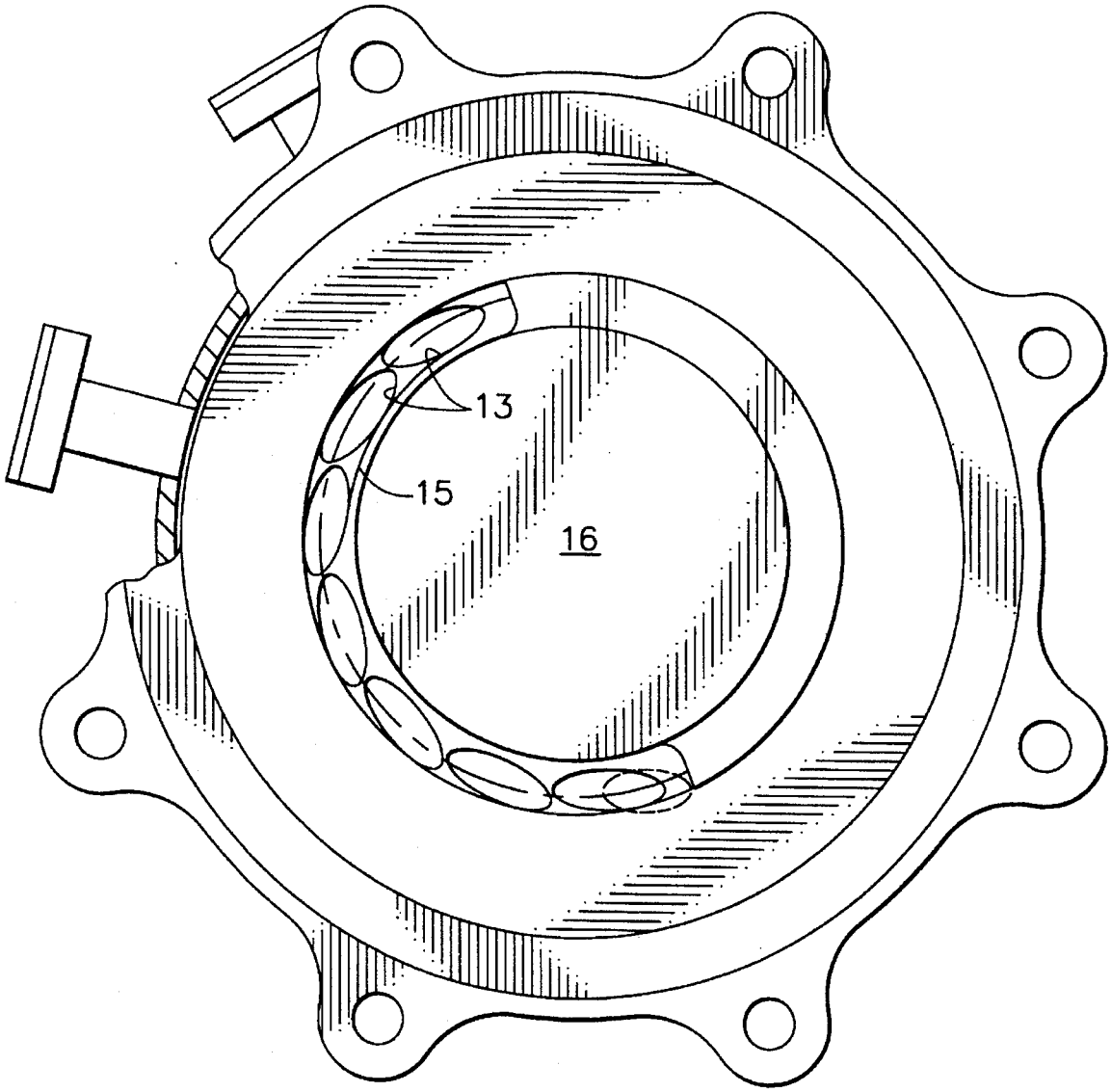
FIG. 7 is a diagrammatic representation particularly showing a rotating cover configuration for enhancing the features of the invention.

With particular reference to FIG. 7, cover 16 can be extended as shown to further enhance the purpose of the invention which is to reduce pumping losses as will be appreciated.

There has thus been described a partial admission axial impulse turbine including a cover which is affixed to the turbine housing on the downstream side of the turbine wheel rotating assembly to reduce the inherent pumping loss occurring when the blades of the rotating turbine wheel create a pressure gradient. The cover is arranged to leave a portion of the annular area at the exit face of the turbine wheel open for gas flow out of the turbine blades, with the remaining portion of the annular area being covered, so that a close axial clearance between the cover and the rotating assembly is provided. The arrangement described minimizes the condition whereby the blades of the rotating turbine wheel create a pressure gradient and pumping loss which results in a loss in turbine power and an attendant decrease in turbine efficiency.

The invention has been illustrated and described with reference to a partial admission axial impulse turbine having a plurality of nozzles 13 covering approximately fifty percent of annular area 15. It will be appreciated that turbines of this type may have more or less nozzles than described. As a matter of fact, a partial admission turbine may be effectively designed with only one such nozzle. In any event, cover 16 may be diminished or enlarged, as the case may be, to cover only that portion of annular area 15 not covered by nozzles 13 in order to serve the purposes of the invention, as will now be appreciated.

With the above description of the invention in mind, reference is made to the claims appended hereto for a definition of the scope of the invention.

What is claimed is:

1. An axial impulse partial admission turbine, comprising:

a plurality of nozzles configured in an array forming a partial arc, each of said nozzles comprising an opening for allowing gas to flow therethrough;

a rotating turbine wheel having an inlet face opposite said are shaped nozzle array and an exit face on the side opposite the inlet face;

a turbine wheel housing enclosing a portion of the rotating turbine wheel and providing an exit plenum adjacent the exit face of the turbine wheel; and a turbine pressure gradient control cover positioned in said exit plenum and affixed to the turbine wheel housing, opposite the turbine wheel exit face covering a portion of the turbine exit face not axially aligned with the arc shaped nozzle array, wherein gas flowing through said nozzle array flows axially through the turbine, and the cover reduces peripheral gas flow past the exit face of the turbine wheel to thereby reduce the turbine pressure gradient loss and increase turbine efficiency.

2. An axial impulse turbine, comprising:

at least one nozzle having an opening for guiding a flow of gas;

a rotating turbine wheel having an inlet face proximate the nozzle and an exit face on a side opposite the nozzle;

a turbine wheel housing enclosing the rotating turbine wheel and forming an exit plenum with said exit face; and a cover affixed the turbine wheel housing, opposite the turbine wheel exit face and covering more than half the exit face but not those portions axially aligned with the nozzle opening, wherein gas flows axially, not peripherally, past the turbine wheel, and the cover increases efficiency of the turbine wheel by reducing a pressure gradient to avoid loss in turbine power that can reduce efficiency.

3. A method for reducing the exit plenum pressure gradient created by a rotating turbine wheel of an axial impulse partial admission turbine, whereby a loss in turbine power and efficiency is reduced, comprising the steps of:

providing a rotating turbine having an exit plenum, providing gas to the turbine wheel through an arc shaped array of nozzle openings;

rotating the turbine wheel by guiding the gas axially through said turbine wheel, and covering a substantial portion of the turbine exit face with a cover to thereby reduce a gas pressure gradient in the exit plenum.

4. The method of claim 3 wherein the turbine comprises a hub and plurality of blades radially extending form said hub and said cover covers substantially all of said hub and substantially all blades not axially aligned with said arc shaped array of nozzle openings.

5. An axial impulse turbine as described by claim 1, further comprising a clearance between the cover and the turbine wheel.

6. An axial impulse turbine as described by claim 2, further comprising a clearance between the cover and the turbine wheel.

7. An axial impulse turbine as described by claim 1 wherein: the turbine wheel is located on a longitudinal axis, and said cover is affixed downstream of the turbine wheel and intersects this axis.

8. An axial impulse turbine as described by claim 2, wherein: the turbine wheel is located on a longitudinal axis, and said cover is affixed downstream of the turbine wheel and intersects this axis.

9. A method as described by claim 3 whereby covering the openings includes:

affixing a cover to turbine wheel housing, said housing enclosing the turbine wheel.

10. A method as described by claim 3, including:

affixing the cover a minimum distance from the turbine wheel for optimizing turbine performance.

11. An axial impulse turbine as claimed in claim 5 wherein the clearance is minimized for optimum performance.

12. An axial impulse turbine as claimed in claim 6 wherein the clearance is minimized for optimum performance.

13. An axial impulse turbine as claimed in claim 1 wherein the inlet face further comprises a solid area, and said cover covers the solid area.

14. An axial impulse turbine as claimed in claim 2 wherein the inlet face further comprises a solid area, and said cover covers the solid area.

* * * * *